US006166645A

United States Patent [19]

Blaney

[11] Patent Number: 6,166,645

[45] Date of Patent: Dec. 26, 2000

[54] ROAD SURFACE FRICTION DETECTOR AND METHOD FOR VEHICLES

[76] Inventor: Kevin Blaney, P.O. Box 1980, Englewood, Colo. 80150

[21] Appl. No.: 09/231,392

[22] Filed: Jan. 13, 1999

[51] Int. Cl.[7] ..... G08B 19/02

[52] U.S. Cl. ..... 340/583; 340/522; 250/339.11

[58] Field of Search ..... 340/583, 522, 340/508, 425.5, 449; 250/339.11, 574

[56] References Cited

U.S. PATENT DOCUMENTS

| | | | |
|---|---|---|---|
| 4,274,091 | 6/1981 | Decker | 340/583 |
| 4,379,227 | 4/1983 | Kovacs | 340/583 |
| 5,105,157 | 4/1992 | Schmitt | 324/644 |
| 5,218,206 | 6/1993 | Schmitt et al. | 250/339 |
| 5,385,612 | 1/1995 | Li | 134/18 |
| 5,416,476 | 5/1995 | Rendon | 340/580 |
| 5,745,051 | 4/1998 | Doherty et al. | 340/580 |
| 5,818,339 | 10/1998 | Giles et al. | 340/583 |

*Primary Examiner*—Daniel J. Wu
*Attorney, Agent, or Firm*—Edwin H. Crabtree; Ramon L. Pizarro; Donald W. Margolis

[57] ABSTRACT

A road surface friction detector for use in a vehicle. The detector provides information regarding the integrity of a road surface to an operator of the vehicle. The detector is made up of three main parts, a sensor unit, a display unit and a microprocessor unit. The sensor unit is made up of a first sensor unit and a second sensor unit. The first sensor unit contains a first light source which directs light at the road surface to be reflected back to a first light receiver. The amount of light that returns to the first light receiver corresponds to various conditions on the road. The second sensor unit is made up of a second light source, second light receiver and a reflective element. The second light source directs light at the reflective element which is located between the second light source and the road. The light from the second light source is then reflected off of the reflective element to the second light receiver. The second sensor unit provides a controlled reflective environment against which the level of interference due to dirt and debris may be measured. The display unit is what relays the information that is gathered by the sensor unit to the operator of the vehicle in a manner in which it may be used. The microprocessor unit receives, translates and transmits data to and from the sensor and display units.

11 Claims, 2 Drawing Sheets

ROAD SURFACE FRICTION DETECTOR AND METHOD FOR VEHICLES

BACKGROUND OF THE INVENTION

This invention relates generally to a type of device for detecting the existence of ice, that may cause an inadequate amount of friction, in the path of an automobile and alerting the driver to the existence of such roadway conditions.

A significant problem in driving during inclement weather conditions is that of ice on the roadway, with its obvious dangers to safe operation of a car or truck. Ice on the roadway can be visible if sunlight or artificial light is adequate, or it can be so-called black ice, which is extremely difficult for a driver to see until the vehicle is virtually on top of the icy patch, by which time it may be too late for the driver to safely slow the vehicle or control a turn with skidding. Additionally, the increasingly greater levels of sound insulation and ergonomic comfort features that are being provided in modern vehicles make it more likely that a driver will be in a less alert state of mind, and for that reason the driver may not detect the existence of ice on the road until it may be too late to correct the vehicle's speed or direction. Therefore, it has long been recognized that a need exists for some way of detecting the presence of ice in the path of a vehicle and of alerting the driver of such conditions before it is too late for the driver to compensate for such icy road conditions.

A significant problem is posed by the variety of roadway ice detectors that have been previously known in the art, in that they generally rely upon some type of optical sensor to detect the existence of precipitation on the roadway. Such sensors are generally disclosed to be somewhere under the vehicle carriage, which means that the sensors will be subjected to accumulation of roadway dirt, mud grime, and so forth, the accumulation of which on the sensor surface will assuredly degrade the accuracy and performance of the ice detection system. Therefore, a need exists in the art for a reliable accurate ice detection system that can sense, correct for and remedy the accumulation of roadway dirt on the critical sensor components of the system It is therefore a goal of the present invention to provide for an optical roadway precipation sensing system that can detect for the presence of a dangerously great accumulation of roadway dirt on one or more components of the system. Another goal of the invention is to decrease the rate of accumulation of such dirt by shielding the componentry from such dirt as the vehicle travels along. Another goal of the invention is to be able to remove accumulations of such dirt from the componentry to maximize the performance of the system. Another goal of the invention is to incorporate into the ice warning system an ambient air temperature sensor that would take constant real time temperature readings of the air surrounding the vehicle and feed that data into the warning system. Yet another goal of the invention is to alert the driver when the ice warning system is not turned on by providing for an on/off switch that would be constantly illuminated when in the "Off" position, thus warning the driver that the system is not functional.

The invention features an electronic system to be installed on existing motor vehicles or incorporated into the production of new vehicles, which, when properly installed, can detect when road conditions are hazardous, especially with regard to being icy. The system features a dashboard-mounted display, a microprocessor unit, and a sensor unit which is mounted under the vehicle. The dashboard display is the driver's interface with the instrument. The sensor unit features a light source in either the visible or the infra-red range. The wavelength chosen is to maximize the difference in reflectance from a dry road surface to an icy surface. Since there is a possibility of light of a similar wavelength being introduced from an external source that could detract from the accuracy of the unit, the instrument's light beam is modulated, or turned on and off, at a specific rate to make it distinctive from outside illumination. The unit also features a second light source and receiver. The second light source and receiver are exposed to the same environment as the main sensor and include a reflective element to return a light signal to the receiver. Whenever dirt is present, this return signal is decreased. When a dirty sensor is detected, the dashboard display is disabled so that it will not give off a false signal, and additionally, distinctive lighting in the display will alert the driver to sensor innacuracy due to the presence of dirt on the unit. The invention features a microprocessor unit that handles the detection of signals returned from the road surface and whether the strength of the signal indicates ice or not. The microprocessor also monitors the dirt sensor signal to determine if dirt is impairing the accuracy of the unit. The sensitivity of the measurement signal changes in response to the amount of dirt present until there is so much dirt that accuracy could not be maintained. The invention further features calibration means to calibrate an individual unit to a particular installation. Other objects, features, and advantages of the invention will become more readily apparent to the reader from the following descriptions of the invention and its alternative embodiments.

SUMMARY OF THE INVENTION

In its most basic embodiment, the present invention is a vehicular driving condition monitoring system for warning of dangerous driving conditions on a road surface, a sensor unit mounted on a vehicle for detecting dangerous driving conditions, the sensor unit including a first sensor for detecting excess moisture on said road surface and a second sensor for detecting roadway dirt present on the sensor unit, and means for deriving a dangerous driving conditions signal and means for communicating said dangerous driving conditions signal to an operator of said vehicle. The system can further include sensors mounted on the vehicle for detecting excessive moisture on the road surface, and freezing temperature at the road surface. The sensors are connected through detector circuits to an audible alarm and to a visual display which warns the driver of a dangerous driving condition.

DETAILED DESCRIPTION OF THE PREFERRED EMBODIMENTS

Figure 1:
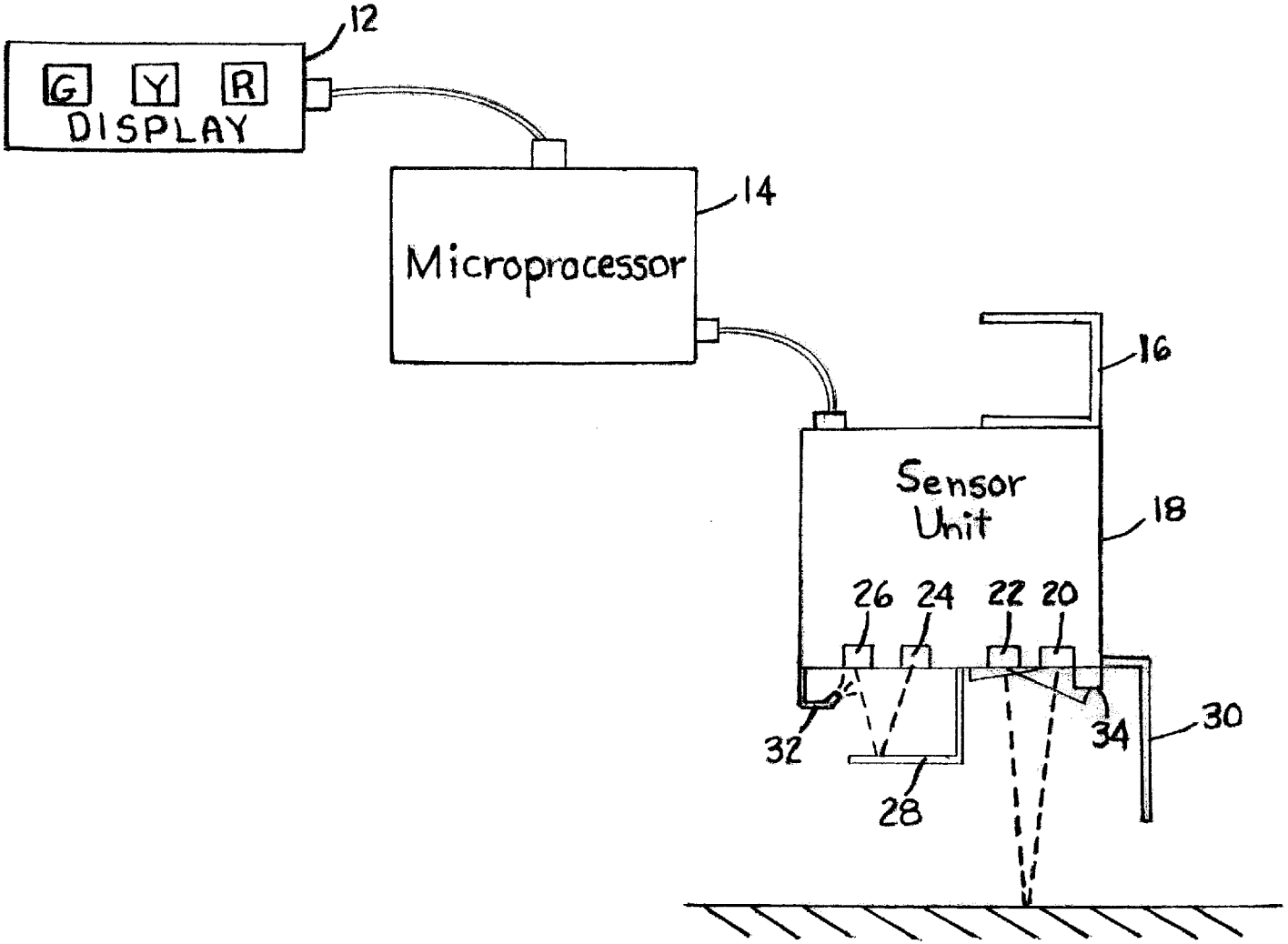
FIG. 1 is a schematic and block diagram of the components of an embodiment of the present invention.

The ice detector system is characterized by three component sub-systems. Firstly there is a sensor unit 18 mounted underneath a vehicle frame 16. The sensor unit 18 includes a first light source 20, a first light receiver 22, a second light source 24 and a second light receiver 26. Secondly, there is a microprocessor unit 14, which contains the bulk of the electronics means, and thirdly there is a display unit 12, which is the driver's interface with the system.

The system of the invention partly relies on the concept of a primary sensor that can sense the existence of ice on a road by directing a beam of light at the road surface. It is known that a dry road will reflect little of such directed light back to a light receiving sensor, but an icy road will reflect a correspondingly greater amount of light back onto the first light receiver 22. The amount of light sensed by the first light receiver 22 can be measured and quantified. Such light sensors are known to those of ordinary skill in the art and are disclosed in U.S. Pat. No. 4,274,091, issued Jun. 16, 1981; U.S. Pat. No. 5,416,476, issued May. 16, 1995; and U.S. Pat. No. 5,218,206, issued Jun. 8, 1993; the entire disclosures of which are incorporated herein by reference. The sensor unit 18, which contains the first light source 20, can emit in either the visible or the infra-red range of light. The light wavelength is chosen so as to maximize the difference in reflectance from a dry road surface to an icy road surface, according to means well known to those of ordinary skill in optics. The return signal is rectified to obtain a DC voltage proportional to the returned signal amplitude. Preferably, multiple wavelengths of light are used in a predetermined emission sequence or simultaneous array to increase the accuracy of determinations of whether the road is icy or dry. Also, since there is generally a possibility of light of a similar wavelength being introduced from an external source other than the vehicle's emitter, the vehicle's emitted light can be modulated, that is, turned on and off at a specific rate to make it distinctive from such interfering outside sources of light. The modulated output is controlled by the microprocessor unit 14, described further below, which uses an internal timer to generate its modulation frequency for the light sources.

The sensor unit 18 also contains the second light source 24 the second light 26, whose function it is to detect the presence of dirt in the system. The second light source 24 and second light receiver 26, which are preferably immediately adjacent the first light source 20 and first receiver 22; are always exposed to the same environment as the primary sender, but additionally include a mechanical reflective element 28 to always return a light signal to the receiver. In the presence of dirt, the return signal would be decreased. The presence of dirt would impair the function in the first light receiver 22 since the light from an icy road would not be detected through the dirt. When a dirty sensor is detected, the system can alert the driver of the vehicle to the dirty condition of the sensors; additionally, the display unit 12 can optionally be disabled so that it would not give a false clear road signal or the indicator lights can be flashed in a distinctive way to indicate the sensor is not functioning. In another preferred embodiment, when a dirty sensor signal is received, the driver can turn on washing unit 32 that will clean the system's optical components, which are shielded by a clear glass or polymeric shield, relying on water and/or solvent sprayed onto the optical components' shield from the vehicle's reservoir used for washing the vehicle's windshield and headlights. As an adjunct to this washing function, another preferred embodiment supplies a small rubber bladed mechanical wiper arm 34 that is powered in a back-and-forth sweep over the clear shield by a small electric motor of the type well known and presently in use to clean vehicle headlights. Additionally, it may sometimes be the case that slush or water spray has gotton onto the components of the sensors and, while the vehicle was parked, frozen onto the optical portions of the system. To meet this situation, there is in another preferred embodiment an electrical heating element of the type commonly found in automobile rear windshields that can rapidly melt such frozen accumulations off of the system Another alternative embodiment of the invention seeks to prolong the intervals between cleanings of the optics' shields by providing a dirt shield 30 to the flow of air under the vehicle. This is simply an air dam means mounted far enough in front of the optical transmitter and sensor so as not to impede the light transmissions, but close enough to provide a divertor to air flows in the immediate area of the optics, thus helping keeping the area cleaner longer.

An alternative embodiment of the invention includes a moisture monitoring means circuit. A suitable such means known to those of skill in the art consists of a pair of thermistors which are configured as sensing elements in the circuit. A first thermistor is sealed in an enclosure which prevents direct contact with the outside air. A second thermistor is mounted in an enclosure which allows air from near the road surface to flow freely about the device. Like ends of the thermistors are connected through a limiting resistor to ground, while the other ends of the thermistors are connected to the two inputs of a differential amplifier means. The thermistors are also connected through equal resistors and to a rheostat which is connected to a twelve volt supply line. The rheostat and the resistors comprise a voltage divider which is adjustable to equalize the voltage applied to the two inputs of the differential amplifier. When moisture-laden air comes into contact with the exposed thermistor, heat is dissipated into the air via the moisture content thereof, cooling the thermistor and altering its electrical resistance. The sealed thermistor will not dissipate its heat as quickly, and its resistance will not change as quickly. (Both thermistors are self-heated by the small current flowing through them.) If the imbalance in the resistances of the thermistors becomes sufficiently large, as when excess moisture is on the roadway, a voltage differential will be developed and applied to an amplifier means, triggering an output therefrom. In the preferred embodiments here, this function is likewise handled by the microprocessor unit 14.

An alternative preferred embodiment of the invention includes a temperature monitoring means circuit. A suitable such means known to those of skill in the art consists of a temperature sensor connected between a twelve volt vehicle power supply and a suitable resistance means to a light emiting diode means and/or an audio signal means. Suitable temperature sensors include, for example, freeze sensor model no. MCI-5B, manufactured by Midwest Comp, Inc. This device features a temperature sensing read switch which includes a magnetic actuator in which the magnetic reluctance varies markedly with the ambient temperature. When the switch closes in response to ambient freezing temperatures, the twelve volt vehicle supply is applied directly to the LED or audio signal generator causing the LED to light and the audio signal to actuate.

Figure 2:
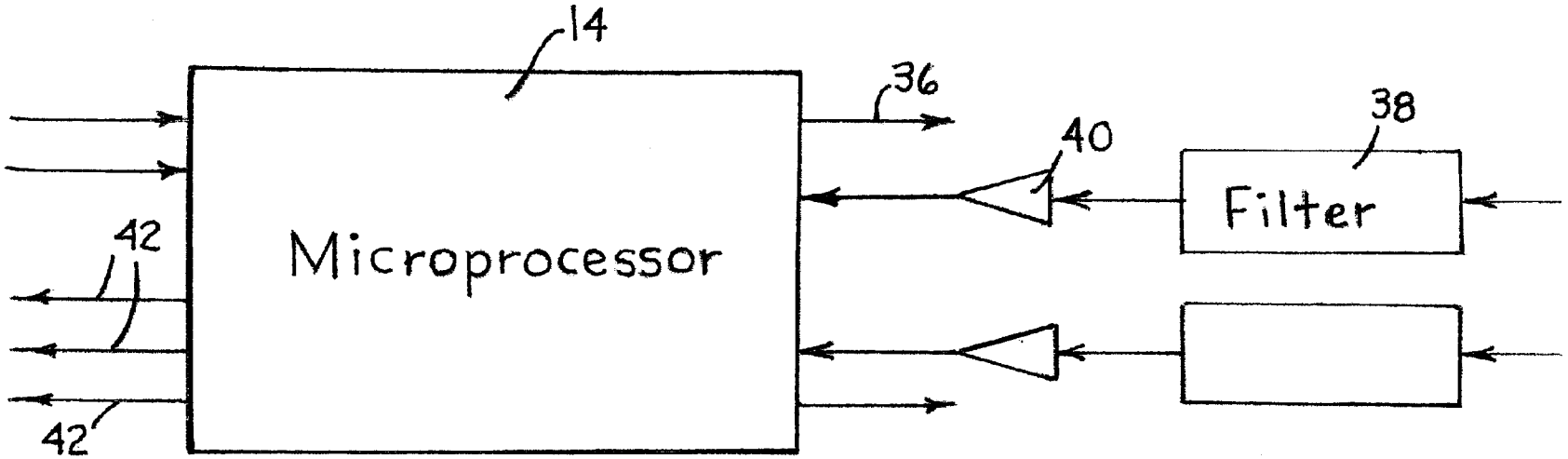
FIG. 2 is a chart illustrating operation of the present invention.

A single chip microprocessor can be used to handle the entire system. Such microprocessors are known to those of ordinary skill in the art and are disclosed in U.S. Pat. No. 4,274,091, issued Jun. 16, 1981; U.S. Pat. No. 5,416,476, issued May. 16, 1995; and U.S. Pat. No. 5,218,206, issued Jun. 8, 1993; the entire disclosures of which are incorporated herein by reference. Part of the microprocessor unit's 14 function is to generate a modulation frequency 36, shown in FIG. 2, via an internal timer for the light sources for the sensor unit 18 and it would further have an on-board analog to digital converter to measure the signals returned from the sensors, which have passed through a filter 38 and an amplifier and rectifier 40. Filter 38 only allows signals to pass through it that are at the correct frequency to be amplified and measured. The return signal is then rectified to obtain a DC voltage proportional to the returned signal amplitude. The microprocessor unit 14 would drive the indicator LEDs and audible alarm directly through outputs 42 and interface to the user calibration switches. The microprocessor handles detection of the signals returned from the road surface and determines whether the strength of the return signal indicates ice or not. The microprocessor also monitors the second signal to tell if dirt is impairing reading accuracy. The sensitivity of the measurement signal can be changed in response to the amount of dirt present until there is so much dirt that accuracy can not be maintained. The microprocesor unit 14 also has means for calibrating the individual units to a particular installation. Different vehicles would have the sensor unit 18 mounted at different heights above the road surface and thus would have different return signals for the same road conditions. This calibration can, for example, be performed from the in-car display with two push button means controls, with one being able to make the reading more sensitive and one to make the reading less sensitive. For example, if the unit were indicating an icy road, and the driver determined by other means that the road was not icy, he could push a button under the green light to make the reading go from red to yellow. Vice versa, if the driver determined that the road was icy when the in-car display only indicated a warning, he could push a button under the red indicator to move the display to a red indication. Additionally, microprocessor unit 14 can be made to accept and process signals from the alternative embodiment ambient temperature sensor and the alternative embodiment moisture sensor, in order to produce display indications that show icy road conditions, taking these additional physical parameters into account. In additional embodiments of the invention, additional sensors send signals to an appropriately engineered microprocessor 14 that reflect how fast the vehicle is moving, the extent, if any, to which lateral gravity forces are acting on the vehicle (ie when the vehicle is cornering) and ambient relative humidity around the vehicle. These additional parameters can be advantageously used by the microprocessor 14 to arrive at more precise data about icy road conditions.

Additional circuitry involves an amplifier means, a bandpass filter means, which is tuned to respond only to the modulation frequency, and a rectifier circuit means, which develops a DC voltage proportional to the returned signal that would be applied to the microprocessor's analog to digital converters. These components are well known to those of skill in the art.

The detection system is powered from the vehicle's battery and turns on automatically when the ignition is turned on. After being turned on, the unit executes a self test which preferably is communicated to the driver by temporarily lighting up all of the dashboard displays for several seconds to demonstrate to the driver that all of the indicators are in working order. The system then continuously monitors road conditions and reports them to the driver via the dashboard display.

As the vehicle moves along the roadway, several readings per second are generated with a weighted average figure being constantly generated to signify how much light is reflected from the road surface.

In a most preferred display embodiment, a multiple colored LED display having red, yellow and green color components notifies the driver of the relative extent of the hazardous conditions ahead. Hence, green would indicate a dry road, yellow would indicate a road that may be icy and caution should be observed, and red would indicate that the road is definitely icy. Preferred parameters for this feature are that if there is precipitation on the road and the temperature is between 30 to 35 degrees F., the yellow warning light would come on, and if the temperature were to fall below 30 degrees F. in the presence of precipation on the road, the red warning light would come on. Another feature of a most preferred embodiment of the invention is an audible alert means that can sound off to let the driver know of icy conditions if the driver is not paying attention to the dashboard display functions of the system.

Different vehicles would have the sensor unit mounted at different heights above the road surface and would have different return signals for the same road conditions. Calibration is performed from the dashboard display via push button control means.

While the above description constitutes a preferred embodiment of the present invention, it is to be understood that the invention is not limited thereby and that in light of the present disclosure of the inventions various other alternative embodiments will be apparent to persons skilled in the art. In particular, where specific numerical values are mentioned, such are by way of illustration and not limitation. It is also clear that specified component parts are amenable to various substitutions as those skilled in the art can recognize. Accordingly, it is to be understood that changes can be made without departing from the scope of the invention as particularly pointed out and distinctly claimed in the claims set forth below. It is intended, therefore, that the invention be limited only by the scope of the claims which follow, and that such claims be interpreted as broadly as possible.

What is claimed is:

1. A road surface friction detector for use in a vehicle, the detector providing information regarding the integrity of a road surface to an operator of the vehicle, the detector comprising:

a sensor unit, said sensor unit being adapted for attachment to an underside of the vehicle, said sensor unit including:

a first sensor, said first sensor including a first light source and a first light receiver, said first light source directing light to reflect off of the road surface, the reflection of the light received by said first light receiver, whereby the amount of light received by said first light receiver indicating various road conditions, a second sensor, said second sensor including a second light source and a second light receiver, said second sensor further including a reflective element, said second light source directing light at said reflective element, said second light receiver receiving light reflected off of said reflective element whereby said second sensor providing a controlled reflective environment so as to allow interference due to dirt and debris build up on said first and second sensors to be measured;

a display unit, said display unit including controls for said sensor unit, whereby said display unit providing the operator with signals corresponding to various road conditions and signaling the operator that said sensor unit is disabled because of dirt and debris; and a microprocessor unit, said microprocessor unit connected to said sensor unit and said display unit, said microprocessor unit generating a modulation frequency for a series of light pulses to be emitted by said first and second sensors, whereby the modulation frequency reducing the amount of interference in said first and second sensors from an outside light source.

2. The road surface friction detector as described in claim 1 further including a dirt shield, said dirt shield being made up of a wall of solid material protruding in a downward direction, said dirt shield being located at a front end of said sensor unit and extending the entire width of said sensor unit so as to protect said first and second sensors from wind-carried dirt and debris.

3. The road surface friction detector as described in claim 1 further including a washing unit, said washing unit located on said sensor unit, said washing unit used for cleaning said first and second sensor so that the light that is emitted and received by said first and second sensor is not inhibited by dirt and debris.

4. The road surface friction detector as described in claim 3 wherein said washing unit is a bladed mechanical wiper arm.

5. A road surface friction detector for use in a vehicle, the detector providing information regarding the integrity of a road surface to an operator of the vehicle, the detector comprising:

a sensor unit, said sensor unit being adapted for attachment to an underside of the vehicle, said sensor unit including:

a first sensor, said first sensor including of a first light source and a first light receiver, said first light source directing light to reflect off of the road surface, the reflection of the light received by said first light receiver, whereby the amount of light received by said first light receiver indicating various road conditions, a second sensor, said second sensor including a second light source and a second light receiver, said second sensor further including a reflective element, said second light source directing light off of said reflective element, said second light receiver receiving light reflected off of said reflective element whereby said second sensor providing a controlled reflective environment so as to allow interference due to dirt and debris build up on said first and second sensors to be measured;

a display unit, said display unit including controls for said sensor unit, whereby said display unit providing the operator with signals corresponding to various road conditions and signaling the operator that said sensor unit is disabled because of dirt and debris;

a microprocessor unit, said microprocessor unit connected to said sensor unit and said display unit;

a dirt shield, said dirt shield being made up of a wall of solid material protruding in a downward direction, said dirt shield being located at a front end of said sensor unit and extending the entire width of said sensor unit so as to protect said first and second sensor from the wind-carried dirt and debris; and a washing unit, said washing unit being located on said sensor unit, said washing unit used for cleaning said first and second sensor so that the light that is emitted and received by said first and second sensor is not inhibited by dirt and debris.

6. The road surface friction detector as described in claim 5 wherein said microprocessor unit is capable of generating a modulation frequency for a series of light pulses to be emitted by said first and second sensors, whereby the modulation frequency reducing the amount of interference in said first and second sensors from an outside light source.

7. The road surface friction detector as described in claim 5 wherein the positions of said first light source and said first light receiver are adjusted by a control attached to said display unit for the purpose of calibration.

8. The road surface friction detector for use in a vehicle, the detector providing information regarding the integrity of a road surface to an operator of the vehicle, the detector comprising:

a sensor unit, said sensor unit being adaptable for attachment to an underside of the vehicle, said sensor unit including a first sensor and a second sensor;

a display unit, said display unit including controls for calibrating said sensor unit, whereby said display unit providing the operator with signals corresponding to various road conditions and signaling the operator that said sensor unit is disabled because of dirt and debris;

a microprocessor unit, said microprocessor unit connected to said sensor unit and said display unit, said microprocessor unit generating a modulation frequency for a series of light pulses to be emitted by said first and second sensors, whereby the modulation frequency reducing the amount of interference in said first and second sensors from an outside light source;

a dirt shield, said dirt shield being made up of a wall of solid material protruding in a downward direction, said dirt shield located at a front end of said sensor unit and extending the entire width of said sensor unit so as to protect said first and second sensor from wind-carried dirt and debris; and a washing unit, said washing unit being located on said sensor unit, said washing unit used for cleaning said first and second sensor clean so that the light that is emitted and received by said first and second sensor might not be inhibited by dirt and debris.

9. A road surface friction detector as described in claim 8 in which said first sensor includes a first light source and a first light receiver, said first light source being positioned so as to be capable of directing light towards the road surface and said first light receiver being positioned so that it might be capable of detecting how much of the light from said first light source is being reflected off of the road surface.

10. A road surface friction detector as described in claim 9 wherein the positions of said first light source and first light receiver are adjustable by a control attached to said display unit for the purpose of calibration.

11. A road surface friction detector as described in claim 8 wherein said second sensor includes a second light source and a second light receiver, said second sensor further containing a reflective element located between said second sensor and the road surface, said second light source directing light at said reflective element, said second light receiver being located to receive light from said second light source reflected off of said reflective element, whereby said second sensor providing a controlled reflective environment so as to allow the level of interference said detector is experiencing due to the build up of dirt and debris to be measured.

* * * * *